US005091357A

United States Patent [19]

Kosaka

[11] Patent Number: 5,091,357

[45] Date of Patent: Feb. 25, 1992

[54] HEAT SENSITIVE RECORDING MATERIAL

[75] Inventor: Takao Kosaka, Himeji, Japan

[73] Assignee: Mitsubishi Paper Mills Limited, Tokyo, Japan

[21] Appl. No.: 655,773

[22] Filed: Feb. 15, 1991

[30] Foreign Application Priority Data

Feb. 26, 1990 [JP] Japan ..... 2-046678

[51] Int. Cl.[5] ..... B41M 5/40

[52] U.S. Cl. ..... 503/207; 427/152; 503/200; 503/226

[58] Field of Search ..... 427/152; 503/200, 226, 503/207

[56] References Cited

FOREIGN PATENT DOCUMENTS

| | | | |
|---|---|---|---|
| 3741417 | 6/1988 | Fed. Rep. of Germany | 503/226 |
| 43-4160 | 2/1968 | Japan | 503/226 |
| 45-14039 | 5/1970 | Japan | 503/226 |
| 57-52915 | 11/1982 | Japan . | |
| 58-76293 | 5/1983 | Japan . | |

OTHER PUBLICATIONS

German Patent Office Official Action Dated Mar. 8, 1991 and translation of same.

"Japanese Industrial Standard Testing Methods for Pigments", JIS K5101-1964, UDC 667.622:620.1, pp. 1-15.

*Primary Examiner*—Pamela R. Schwartz

*Attorney, Agent, or Firm*—Cushman, Darby, Cushman

[57] ABSTRACT

A heat-sensitive recording material comprising a substrate, an intermediate layer formed on the substrate, and a heat-sensitive recording layer formed on the intermediate layer, said intermediate layer comprising an inorganic powder having an oil absorption of 50 ml/100 g or more as measured in accordance with JIS K5101, an aqueous adhesive and a carboxymethyl cellulose in an amount of 3 to 20% by weight based on the weight of the aqueous adhesive, and said heat-sensitive recording layer comprising an electron-donating, colorless dye precursor, an electron-accepting developer and a sensitizer. Said heat-sensitive recording material has a high sensitivity and hardly causes scum adhesion to a thermal head.

2 Claims, No Drawings

HEAT SENSITIVE RECORDING MATERIAL

The present invention relates to a heat-sensitive recording material and more particularly it relates to a heat-sensitive recording material comprising a substrate, a heat-sensitive recording layer and an intermediate layer formed between them.

For thermal recording, many methods have been known for a long time. For example, heat-sensitive recording materials using an electron-donating, colorless dye and an electron-accepting compound have been disclosed in Jap. Pat. Appln. Kokoku (Post-Exam Publn.) Nos. 43-4160 and 45-14039, etc. In recent years, these heat-sensitive recording materials have been used in various fields, for example, in facsimiles, printers, labels, etc. and have become much in demand. Particularly in the field of facsimile, with a reduction of the size of an apparatus and an increase of its operation speed, the following have been requested in recent years: (1) a high sensitivity, i.e., attainment of an image with a sufficient optical density even in the case of recording by a low energy, (2) accurate transfer of a heat-sensitive recording material at the time of recording, and (3) negligible adhesion of a molten matter to a thermal head (hereinafter referred to as "scum adhesion").

For enhancing the sensitivity, there is carried out, for example, formation of an intermediate layer of a pigment having high oil absorbing properties [Jap. Pat. Appln. Kokoku (Post-Exam Publn.) No. 57-529159 , or pulverization of an electron-donating, colorless dye and an electron-accepting compound [Jap. Pat. Appln. Kokai (Laid-Open) No. 58-76293]. However, in general, the enhancement of the sensitivity results in considerable scum adhesion.

For reducing the scum adhesion, there is carried out, for example, addition of an inorganic pigment to the aforesaid intermediate layer or a heat-sensitive layer. However, such a method is not sufficiently effective in some cases and does not permit both enhancement of the sensitivity and prevention of the scum adhesion.

The present invention is intended to provide a heat-sensitive material which has a high sensitivity and hardly causes scum adhesion.

In order to remove the defects described above, the present inventor earnestly investigated and consequently found that this purpose can be achieved by forming an intermediate layer comprising specific components between a substrate and a recording layer.

According to the present invention, there is provided a heat-sensitive recording material comprising a substrate, an intermediate layer formed on the substrate, and a heat-sensitive recording layer formed on the intermediate layer, said intermediate layer comprising an inorganic powder having an oil absorption of 50 ml/100 g or more as measured in accordance with JIS K5101, an aqueous adhesive, and a carboxymethyl cellulose in an amount of 3 to 20% by weight based on the weight of the aqueous adhesive, and said heat-sensitive recording layer comprising an electron-donating, colorless dye precursor, an electron-accepting developer and a sensitizer.

The heat-sensitive recording material of the present invention comprises a substrate, an intermediate layer formed on the substrate, and a heat-sensitive recording layer formed on the intermediate layer.

The intermediate layer comprises as its essential constituents an inorganic powder, an aqueous adhesive and a carboxymethyl cellulose.

The inorganic powder has an oil absorption of 50 ml/100 g or more as measured in accordance with JIS K5101. For improving the sensitivity and reducing the scum adhesion, it is generally preferable that the inorganic powder is porous and has high heat-insulating properties JIS K5101 measures oil absorption by the method described below:

1-5 of the sample are placed on a glass plate (about 250 ×250 ×5 mm). An adequate amount of the boiled linseed oil is dropped from a burette in small quantities on the center of the sample and kneaded thoroughly with a steel spatula.

Both the dripping and kneading operation are continued until a stiff, putty-like conglomerate of oil and pigment has been formed, and the developed sample may be rolled up in spiral shape with a steel spatula. No more oil having been added at this stage, the total amount of the boiled linseed oil added up to this point can be checked and the oil absorption (%) G can be calculated by the following formula:

$$G = \frac{H}{S} \times 100$$

where,

G: oil absorption (%)

H: amount of linseed oil required (ml)

S: weight of the sample (g)

For some kinds of pigment in which the developed putty cannot be rolled up to a spiral shape, the oil dropping and compounding operation is continued until the kneaded sample softens suddenly on the addition of one drop of linseed oil but is not softened to the point of sticking to the glass plate.

For specified pigments (such as lead white or red lead), the weight of the sample shall be separately specified in the individual standard of each pigment.

Specifically, as the inorganic powder, there can be mainly used calcined kaolin, activated clay, silica, calcium carbonate, diatomaceous earth, etc. If necessary, these inorganic powders may be used in combination with kaolin, talc, etc.

As the aqueous adhesive, there can be used styrene-butadiene latices, acrylic resin emulsions, styrene-maleic anhydride copolymers, polyvinyl alcohols, hydroxyethyl celluloses, starches, starch derivatives, caseins, gelatins, etc.

The carboxymethyl cellulose is contained in the intermediate layer in an amount of 3 to 20% by weight based on the weight of the aqueous adhesive. When the carboxymethyl cellulose content is less than 3% by weight, no sufficient sensitivity can be attained. When the content exceeds 20% by weight, the viscosity of a coating fluid becomes too high, so that the coating fluid becomes difficult to coat on the substrate, and moreover the sensitivity of the resulting heat-sensitive recording material is not sufficient.

As the carboxymethyl cellulose, any one may be used so long as it is generally used in recording materials and the like. The carboxymethyl cellulose preferably has a high polymerization degree.

The carboxymethyl cellulose can be obtained by the reaction of an alkali cellulose with a monochloroacetate and is on the market usually in the form of a sodium salt.

The intermediate layer may contain, besides the above essential constituents, additives which are used in common coated papers, for example, dispersants, defoaming agents, and lubricants.

On the other hand, the heat-sensitive recording layer comprises as its essential constituents an electron-donating, colorless dye precursor, an electron-accepting developer and a sensitizer (a sensitivity-improving agent). If necessary, the heat-sensitive recording layer may contain, besides these essential constituents, waxes, metal soaps, ultraviolet absorbers, pigments, etc.

In general, the dye precursor, developer and the sensitizer are added to water together with a binder and ground to obtain a coating composition for heat-sensitive recording layer.

For obtaining a heat-sensitive recording material having a high sensitivity, it is preferable to pulverize at least one member out of the dye precursor, the developer and the sensitizer. It is more preferable to pulverize all of these components.

The diameter of the particles obtained by the pulverization is measured by means of a Micro Track (an apparatus for measuring volume average particle size distribution by a laser diffraction method, mfd. by Nichikiso K.K). Since an extreme increase of the scum adhesion has heretofore occurred when the volume average diameter of the particles becomes 1.0 μm or less, a particle diameter of approximately 1.1 -2.0 μm has been often employed. In the present invention, even when the particles have a diameter of 1.0 μm or less, a heat-sensitive recording material which has a high sensitivity and hardly causes scum adhesion can be obtained by forming the intermediate layer between a substrate and the recording layer.

The electron-donating, colorless dye precursor used in the present invention is not critical so long as it is one which is used in common pressure-sensitive recording sheets, heat-sensitive recording sheets and the like. Specific examples of the electron-donating, colorless dye precursor are as follows: (1) triarylmethane type compounds such as 3,3-bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phalthalide, 3,3-bis-1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide, 3-p-dimethylaminophenyl-3-(1-methylpyrrol-2-yl)-6-dimethylaminophthalide, etc.; (2) diphenylmethane type compounds such as 4,4-bis-dimethylaminobenhydrinbenzyl ether, N-halophenylleucoauramine, N-2,4,5-trichlorophenylleucoauramine, etc.; (3) xanthene type compounds such as rhodamine B-anilinolactam, rhodamine, B-p-nitroanilinolactam, rhodamine B-p-chloroanilinolactam, 3-diethylamino-7-dibebzylaminofluoran, 3-diethylamino-7-octylamino-fluoran, 3-diethylamino-7-phenylfluoran, 3-diethylamino-7-3,4-dichloro-anilinofluoran, 3-diethylamino-7-(2-chloroanilino)fluoran, 3-diethylamino-6-methyl-7-anilinofluoran, 3-piperidino-6-methyl-7-anilinofluoran, 3-ethyl-tolylamino-6-methyl-7-anilinofluoran, 3-ethyl-tolylamino-6-methyl-7-phenethyl-fluoran, 3-diethylamino-7-(4-nitroanilino)-fluoran, etc.;

(4) thiazine type compounds such as benzoylleucomethylene blue, p-nitrobenzoylleucomethylene blue, etc.;

(5) spiro-compounds such as 3-methyl-spiro-dinaphthopyran, 3-ethyl-spiro-dinaphthopyran, 3,3'-dichloro-spiro-dinaphthopyran, 3-benzyl-spiro-dinaphthopiran, 3-methylnaphtho-(3-methoxy-benzo)-spiropyran, 3-propyl-spiro-dibenzopyran, etc.; and mixtures thereof. These compounds are chosen depending on purposes and desired characteristics.

As the electron-accepting developer used in the present invention, phenol derivatives and aromatic carboxylic acid derivatives are preferable, and bisphenols are particularly preferable.

Specific examples of the phenol derivatives are p-octylphenol, p-tert-butylphenol, p-phenylphenol, 1,1-bis(p-hydroxyphenyl)propane, 2,2-bis(p-hydroxyphenyl)propane, 1,1-bis(p-hydroxyphenyl)pentane, 1,1-bis(p-hydroxyphenyl)hexane, 2,2-bis(p-hedroxyphenyl)hexane, 1,1-bis(p-hydroxyphenyl)-2-ethyl-hexane, and 2,2-bis(4-hydroxy-3,5-dichlorophenyl)-propane.

Specific examples of the aromatic carboxylic acid derivatives are p-hydroxybenzoic acid, ethyl p-hydroxybenzoate, butyl p-hydroxybenzoate, 3,5-di-tert-butylsalicylic acid, 3,5-di-α-methylbenzylsalicylic acid, and polyvalent metal salts of such carboxylic acids.

The waxes include paraffin wax, carnauba wax, microcrystalline wax, polyethylene wax, higher fatty acid amides (e.g. stearic acid amide and ethylenebisstearamide), higher fatty acid esters, etc.

The metal soaps include higher fatty acid polyvalent metal salts such as zinc stearate, aluminum stearate, calcium stearate, zinc oleate, etc.

As the sensitizer, there can be used those which have a sharp melting point of 80° to 140° C. and a satisfactory response to heat. Specific examples of the sensitizer are esters of benzoic acid and terephthalic acid, naphthalenesulfonic acid esters, naphthyl ether derivatives, anthryl ether derivatives, aliphatic ether type sensitizers, phenanthrene, and fluorene. The above-exemplified waxes can also be used as the sensitizer.

The above components constituting each of the intermediate layer and the heat-sensitive recording layer are usually dispersed into water together with a binder and coated on a substrate.

As the binder, water-soluble binders are usually used. The binder includes polyvinyl alcohols, hydroxyethyl celluloses, hydroxypropyl celluloses, ethylene-maleic anhydride copolymers, styrene-maleic anhydride copolymers, isobutylene-maleic anhydride copolymers, polyacrylic acids, starch derivatives, caseins, gelatins, etc. In addition, for imparting water resistance to these binders, it is also possible to add a water-proofing agent (a gelling agent or a crosslinking agent) or an emulsion of a water-resistant polymer, specific examples of which are styrene-butadiene rubber latices and acrylic resin emulsions.

As the support, papers, synthetic papers, nonwoven fabrics, plastic films and the like can be used.

As an apparatus used for coating for formation of the intermediate layer and the heat-sensitive recording layer, there can be used coating machines such as a blade coater, air-knife coater, roll coater, rod coater, curtain coater, etc.

Furthermore, for improving the surface smoothness of coating layer, there can be utilized apparatus such as a machine calender, super calender, gloss calender, blussing machine, etc.

Although the amount of a coating composition for heat-sensitive recording layer coated on a substrate is not critical, it is usually 3 to 15 g/m$^2$, preferably to 10 g/m$^2$ based on dry basis.

It is also possible to form a protective layer on the heat-sensitive recording layer, for example, for improving the solvent resistance.

The action of the carboxymethyl cellulose in the intermediate layer in the present invention is not clear. It can be speculated that although the intermediate layer comprises as its main constituent a pigment which is porous and has high oil-absorbing properties, the carboxymethyl cellulose prevents an adhesive, ground products and the like in the heat-sensitive layer from sinking in the intermediate layer during coating for formation of the heat-sensitive layer, or prevents them from migrating to the intermediate layer during drying.

The present invention is specifically illustrated with the following examples, but which should not be construed as limiting the scope of the invention. In the examples, parts are all by weight.

EXAMPLE 1

FORMULATION OF AN INTERMEDIATE LAYER

| | |
|---|---|
| Ansilex (calcined kaolin mfd. by Engelhard; oil absorption: 80 ml/100 g as measured in accordance with JIS K5101) | 100 parts |
| 10% Sodium hexametaphosphate | 5 parts |
| 48% JSR0629 (a styrene-butadiene latex mfd. by Japan Synthetic Rubber Co., Ltd.) | 30 parts |
| 10% MS-3800 (oxydized starch mfd. by Nihon Shokuhin K.K.) | 10 parts |
| 2% Cellogen WS-C (a carboxymethyl cellulose mfd. by Daiichi Kogyo Seiyaku K.K.) | 100 parts |
| Water | 218 parts |

The above ingredients were stirred to effect dispersion, whereby a coating composition for intermediate layer was prepared. The coating composition was coated on a sheet of wood free paper having a basis weight of 40 g/m$^2$ by means of an air coater in an amount of 8 g/m$^2$ based on dry basis, and then dried to obtain an undercoated sheet.

The content of the carboxymethyl cellulose in the intermediate layer thus formed was 13% based on the weight of the adhesive.

FORMULATION OF A HEAT-SENSITIVE RECORDING LAYER

| | |
|---|---|
| Liquid A: | |
| 3-Dibutylamino-6-metyl-7-anilinofluoran | 100 parts |
| 5% Aqueous hydroxyethyl cellulose solution | 300 parts |
| Liquid B: | |
| 4,4'-Isopropylidene diphenol | 100 parts |
| 2-Benzyloxynaphthalene | 100 parts |
| 5% Aqueous hydroxyethyl cellulose solution | 600 parts |

The liquids A and B were individually pulverized to a particle diameter of 0.5 to 0.8 μm by means of a dynomill (mfd. by Minmal Enterprise).

| Liquid C: The following ingredients were stirred to effect dispersion: | |
|---|---|
| Calcium carbonate | 100 parts |
| 10% Sodium hexametaphosphate | 5 parts |
| Water | 295 parts |

The liquids A, B and C were mixed in the ratio of 1 : 5 : 2. Then, a 10% aqueous polyvinyl alcohol solution was added in an amount of 10% based on the weight of solids, whereby a coating composition for heat-sensitive recording layer was prepared.

The coating composition for heat-sensitive recording layer was coated on the aforesaid undercoated sheet by means of an air-knife coater in an amount of 5 g/m$^2$ based on dry basis, dried at 60° C. or lower, and then finished by means of a super calender to adjust the Bekk smoothness to 400 to 500 seconds, whereby a heat-sensitive recording material was obtained.

EXAMPLE 2

A heat-sensitive recording material was obtained in the same manner as in Example 1, except for changing the content of the carboxymethyl cellulose in the intermediate layer to 20% by weight based on the weight of the aqueous adhesive.

EXAMPLE 3

A heat-sensitive recording material was obtained in the same manner as in Example 1, except for changing the content of the carboxymethyl cellulose in the intermediate layer to 3% by weight based on the weight of the aqueous adhesive.

EXAMPLE 4

A heat-sensitive recording material was obtained in the same manner as in Example 1, except for changing the diameter of particles obtained by individually pulverizing the liquids A and B to 1.2 to 1.5 μm.

EXAMPLE 5

A heat-sensitive recording material was obtained in the same manner as in Example 1, except for using Icecap (calcined kaolin mfd. by Burges Pigment; oil absorption: 55 ml/100 g as measured in accordance with JIS K5101) in place of Ansilex.

COMPARATIVE EXAMPLE 1

A heat-sensitive recording material was obtained in the same manner as in Example 1, except for omitting the carboxymethyl cellulose from the coating composition for intermediate layer.

COMPARATIVE EXAMPLE 2

A heat-sensitive recording material was obtained in the same manner as in Example 1, except for changing the content of the carboxymethyl cellulose in the intermediate layer to 2% by weight based on the weight of the aqueous adhesive.

COMPARATIVE EXAMPLE 3

A heat-sensitive recording material was obtained in the same manner as in Example 1, except for changing the content of the carboxymethyl cellulose in the intermediate layer to 30% by weight based on the weight of the aqueous adhesive.

COMPARATIVE EXAMPLE 4

A heat-sensitive recording material was obtained in the same manner as in Example 1, except for using Ultracoat (kaolin mfd. by Engelhard; oil absorption: 45 ml/100 g) in place of the pigment used in the intermediate layer in Example 1.

Next, the evaluations described below were carried out for the heat-sensitive recording materials obtained in Examples and Comparative Examples.

Using a heat sensitivity tester manufactured by Ohkura Denki K.K., and a thermal head of 16 lines/mm manufactured by Matsushita Denshibuhin K.K., printing was conducted at a speed of major scanning of 2 ms/line, at an energy of 0.3 W/dot, and at an applied pulse of 0.17 ms or 0.32 ms. Then, the densities of the printed images were measured. In addition, scum adhesion to the thermal head after solid printing at an applied pulse of 0.32 ms to a length of 30 m was observed.

The results obtained are shown in the following table.

TABLE 1

| | Content of carboxymethyl cellulose % | Diameter of particles obtained by grinding each of dye precursor and developer μm | Oil absorption of inorganic powder | Image density* 0.17 ms | Image density* 0.32 ms | Scum** adhesion |
|---|---|---|---|---|---|---|
| Example 1 | 13 | 0.5~0.8 | 80 | 0.80 | 1.31 | ○ |
| Example 2 | 20 | " | " | 0.76 | 1.30 | ○ |
| Example 3 | 3 | " | " | 0.78 | 1.32 | Δ |
| Example 4 | 13 | 1.1~1.5 | " | 0.50 | 1.28 | ◎ |
| Example 5 | 13 | 0.5~0.8 | 50 | 0.78 | 1.32 | ○ |
| Comparative Example 1 | 0 | 0.5~0.8 | 80 | 0.78 | 1.32 | X |
| Comparative Example 2 | 2 | " | " | 0.80 | 1.31 | Δ-X |
| Comparative Example 3 | 30 | " | " | 0.50 | 1.29 | ○ |
| Comparative Example 4 | 13 | " | 45 | 0.45 | 1.27 | X |

Note:
*The image density is expressed in terms of values measured by means of a Macbeth densiometer: the larger the figure, the higher the density. In particular, the density at 0.17 ms has a good correlation with the sensitivity. For practical purposes, the image density is preferable 0.6 or more.
**The scum adhesion was judged by observing the degree of adhesion to the thermal head. The rating (mark) shown in the table was as follows:
◎: substantially no scum adhesion i.e., desirable for practical purposes.
○: slight scum adhesion, i.e., acceptable for practical purposes.
○Δ: some scum adhesion, i.e., not disadvantageous for practical purposes.
Δ: somewhat marked scum adhesion, i.e., disadvantageous for practical purposes.
X: considerable scum adhesion, i.e., unsuitable for practical purposes.

As is clear from the table, the heat-sensitive recording material of the present invention gave a high image density and hence had a high sensitivity particularly when recording was conducted by a low energy, and it hardly causes scum adhesion.

What is claimed is:

1. A heat-sensitive recording material comprising a substrate, an intermediate layer formed on the substrate, and a heat-sensitive recording layer formed on the intermediate layer, said intermediate layer formed from an inorganic powder having an oil absorption of 50 ml/100 g or more as measured in accordance with JIS K5101, an aqueous adhesive and a carboxymethyl cellulose in an amount of 3 to 20% by weight based on the weight of the aqueous adhesive, and said heat-sensitive sensitive recording layer comprising an electron-donating, colorless dye precursor, an electron-accepting developer and a sensitizer.

2. A heat-sensitive recording material according to claim 1, wherein at least one member out of the dye precursor, the developer and the sensitizer has a volume average particle diameter of 1.0 μm or less as measured by a laser diffraction method.

* * * * *